US010267111B2

(12) United States Patent
Hart et al.

(10) Patent No.: US 10,267,111 B2
(45) Date of Patent: Apr. 23, 2019

(54) MULTI-TOOL BOTTOM HOLE ASSEMBLY WITH SELECTIVE TOOL OPERATION FEATURE

(71) Applicant: BAKER HUGHES, A GE COMPANY, LLC, Houston, TX (US)

(72) Inventors: Daniel R. Hart, Sugar Lane, TX (US); Andrew D. Ponder, Houston, TX (US); Lambertus C. Joppe, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 218 days.

(21) Appl. No.: 15/147,590

(22) Filed: May 5, 2016

(65) Prior Publication Data

US 2017/0321509 A1 Nov. 9, 2017

(51) Int. Cl.

| | |
|---|---|
| ***E21B 29/00*** | (2006.01) |
| ***E21B 34/06*** | (2006.01) |
| ***E21B 10/32*** | (2006.01) |

(52) U.S. Cl.

CPC ..... *E21B 29/005* (2013.01); *E21B 10/322* (2013.01); *E21B 34/063* (2013.01)

(58) Field of Classification Search

CPC .... E21B 29/005; E21B 10/322; E21B 34/063; E21B 33/12; E21B 34/06

See application file for complete search history.

(56) References Cited

U.S. PATENT DOCUMENTS

| | | | | |
|---|---|---|---|---|
| 2,709,490 | A * | 5/1955 | Trimble | E21B 29/005 166/55.8 |
| 3,339,647 | A * | 9/1967 | Kammerer, Jr. | E21B 10/345 166/171 |
| 4,401,171 | A * | 8/1983 | Fuchs | E21B 10/18 175/237 |
| 5,242,022 | A * | 9/1993 | Burton | E21B 33/1243 166/317 |
| 8,141,634 | B2 | 3/2012 | Fisher et al. | |
| 8,839,864 | B2 * | 9/2014 | Beynon | E21B 29/005 166/297 |
| 8,991,489 | B2 | 3/2015 | Redlinger et al. | |
| 2005/0205305 | A1 | 9/2005 | Stout et al. | |
| 2012/0080231 | A1 * | 4/2012 | Radford | E21B 10/322 175/57 |
| 2013/0299160 | A1 | 11/2013 | Lott | |

(Continued)

FOREIGN PATENT DOCUMENTS

WO 2015073011 A1 5/2015

*Primary Examiner* — Michael R Wills, III

(74) *Attorney, Agent, or Firm* — Shawn Hunter

(57) ABSTRACT

Dual section mills are selectively sequentially operated by locking an actuator for the backup mill as the primary mill has blades extended with internal flow through a housing. When the primary mill is spent the support string is shifted to defeat a lock on an actuation piston for the backup mill so that its blades can extend and continue to mill to finish the job. The blades of the primary mill continue to rotate in the already milled portion of the window as the secondary mill enlarges the window. Another way the secondary mill is actuated is to open access to flow to the secondary mill by removing a pressure barrier such as a valve or a disappearing plug, for example.

5 Claims, 2 Drawing Sheets

(56) References Cited

U.S. PATENT DOCUMENTS

| | | | | |
|---|---|---|---|---|
| 2014/0034317 | A1* | 2/2014 | Hekelaar | E21B 29/005 166/298 |
| 2014/0374170 | A1* | 12/2014 | Baudoin | E21B 10/322 175/406 |
| 2015/0354306 | A1 | 12/2015 | Fuller et al. | |

* cited by examiner

MULTI-TOOL BOTTOM HOLE ASSEMBLY WITH SELECTIVE TOOL OPERATION FEATURE

FIELD OF THE INVENTION

The field of the invention is bottom hole assemblies with multiple tools that can be sequentially operated using a common operating force and more particularly sequentially operated mills where a second mill can take over after an initial mill wears in the same trip in the borehole.

BACKGROUND OF THE INVENTION

Rig time is expensive and is always the subject of efforts to minimize it. One way to do this when running tools that wear out in use is to run in with a backup tool that can be deployed to finish the job should the primary tool either wear out or experience some other operational difficulty. For example in section milling where a length of a tubular is to be milled away to facilitate a lateral exit from a borehole the mills typically have a series of pivoting blades that are held retracted for running in and powered out against the casing or other tubular. Milling can occur in an uphole or a downhole direction depending on blade orientation. The simpler of these devices are pressure actuated so that when flow is initiated an internal piston is pushed whose movement releases a retraction tab on the blades that was employed for running in and another portion of the internal piston pushes the blades from behind against the surrounding tubular. Flow continues out of the tool to remove cuttings from the blades as the assembly is rotated to remove the surrounding tubular. The internal piston using the flow through the tool maintains a contact force on the surrounding tubular as the blades pivot as the milling progresses. A return spring takes over when flow is cut off to again allow the blades to retract to the point where they can be held retracted for tool removal.

If a single tool is run the surface personnel who monitor the milling rate will know from experience that the blades have worn and depending on the progress of the milling at that time it may mean that the tool has to be pulled out of the hole (POOH) and the blades replaced. This is a time consuming process and expensive for the operator. Having a spare mill in the hole would solve this problem but creates another problem. That problem is how to sequentially operate a primary and secondary mill that feature blades extending in response to pressure. The preferred operating method is to run the first mill until it wears and then retract its blades and finish the job with the second mill. The problem is that the same pressure that operates the first mill with extend the blades of the backup mill prematurely. Others skilled in the art have attempted to solve this problem but have failed to do it in a reasonably cost effective manner. Instead they have resorted to complex independent operating systems for the mills that use RFID tags and sensors to retract the blades of the spent mill and then to extend the blades of the second mill. This approach is shown in FIG. 13 of U.S. Pat. No. 8,141,634. The cost of this approach is prohibitive and the size of the tool is potentially increased to house the signal and power components which can make the design too large for use in some applications. Instead, the present invention continues to employ fluid pressure to extend blades but prevents the blades from the backup mill from extending with a lock on its piston actuator that is simply defeated with tool repositioning or simply just prevents actuation pressure that operates the primary mill from reaching the backup mill until the desired time for a switchover between mills. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

Dual section mills are selectively sequentially operated by locking an actuator for the backup mill as the primary mill has blades extended with internal flow through a housing. When the primary mill is spent the support string is shifted to defeat a lock on an actuation piston for the backup mill so that its blades can extend and continue to mill to finish the job. The blades of the primary mill continue to rotate in the already milled portion of the window as the secondary mill enlarges the window. Another way the secondary mill is actuated is to open access to flow to the secondary mill by removing a pressure barrier such as a valve or a disappearing plug, for example.

DETAILED DESCRIPTION OF THE PREFERRED EMBODIMENT

Figure 1:
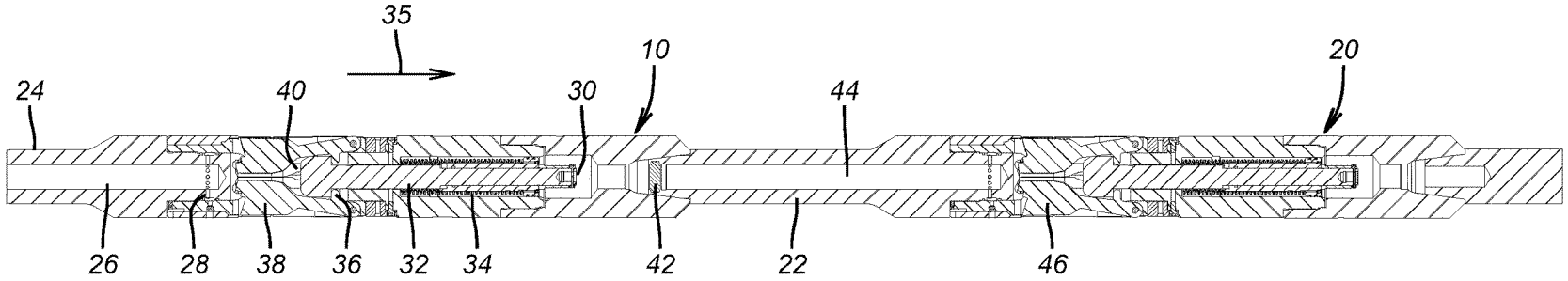
FIG. 1 is a section view of a primary and backup mills with a removable barrier that prevents backup mill blade extension until the barrier is removed.

Referring to FIG. 1, a primary mill 10 is selectively fluidly connected to a backup or secondary mill 20 through a coupling 22. A tubular string 24 has a passage 26 that continues into the primary mill 10. Lateral outlets 28 conduct flow to chamber 30 under actuating piston 32 that is biased in the downhole direction of arrow 35 by spring 34. With no pressure applied in passage 26 the force of spring 34 pulls on tabs 36 to retract the blades 38. With pressure applied in passage 26 piston 32 moves in the opposite direction to arrow 35. The blades 38 are then extended as the spring 34 is compressed. Rotation of the blades 38 cuts into the surrounding tubular that is not shown. Fluid from passage 26 after moving out the blades 38 is exhausted near nozzles 40 that are used to remove cuttings away from the blades 38 and circulate the cuttings uphole for removal.

Chamber 30 is sealed at a lower end with a plug 42. This plug 42 can be a valve or a disintegrating plug, rupture disc or another plug that can be removed by dissolving or some other process. Alternatively, the plug 42 can be retained with breakable members that are not shown to stay in place under pressures normally expected when only the primary mill 10 is operating alone. Raising the pump rate into passage 26 can raise the pressure to break the restraint on plug 42 to allow flow to continue into passage 44 to the secondary mill 20.

The mill 20 can preferably be the same as mill 10 whose operation was described above. Accordingly, when fluid under pressure begins to flow into passage 44 the blades 46 of mill 20 will extend and blades 38 will stay extended and rotate in an already milled zone where they should contact nothing since they will be worn and mill 20 will be used to continue milling. The plug 42 can be removed with adding a fluid to the flow down passage 26 such as water or another fluid that will initiate the failure of plug 42 to hold pressure in any one of a variety of ways. Another way to accomplish the removal of plug 42 is to make the plug responsive to pressure application and removal cycles used concurrently with a j-slot mounting such that after a predetermined number of cycles the plug can move into an enlarged passage to enable flow to go around it for extension of blades 46.

Figure 2:
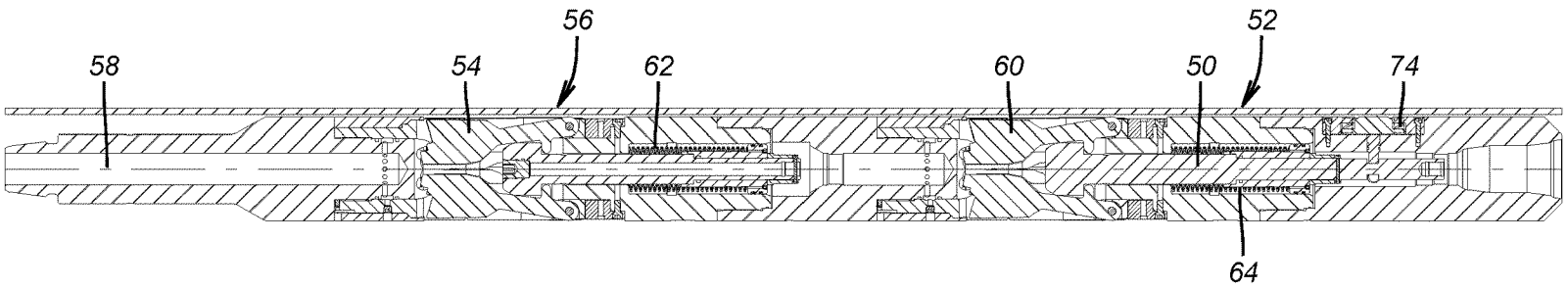
FIG. 2 is a section view of a primary and backup mills in the run in position with the backup mill mechanically locked.
Figure 6:
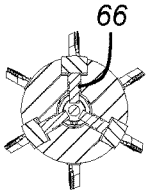
FIG. 6 is a section view along line 6-6 of FIG. 3 showing circumferentially spaced retainers for the actuating piston of the backup mill.
Figure 3:
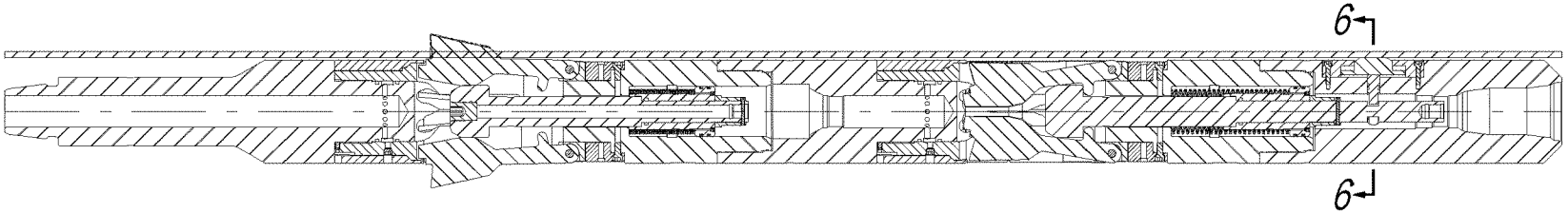
FIG. 3 is a view of FIG. 2 with the blades of the primary mill extended for milling.
Figure 4:
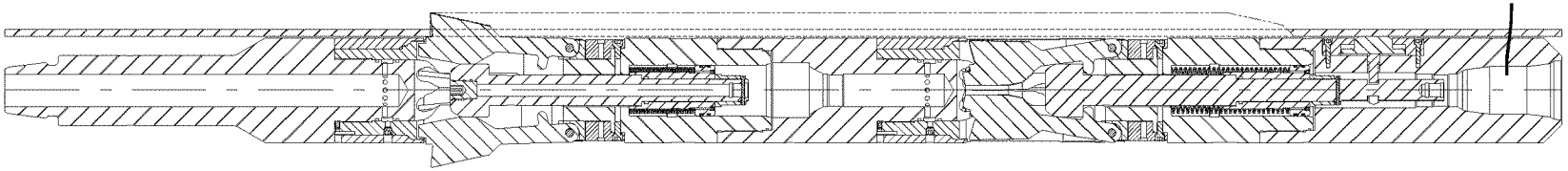
FIG. 4 is the view of FIG. 3 with the primary mill spent after making some of the hole.
Figure 5:
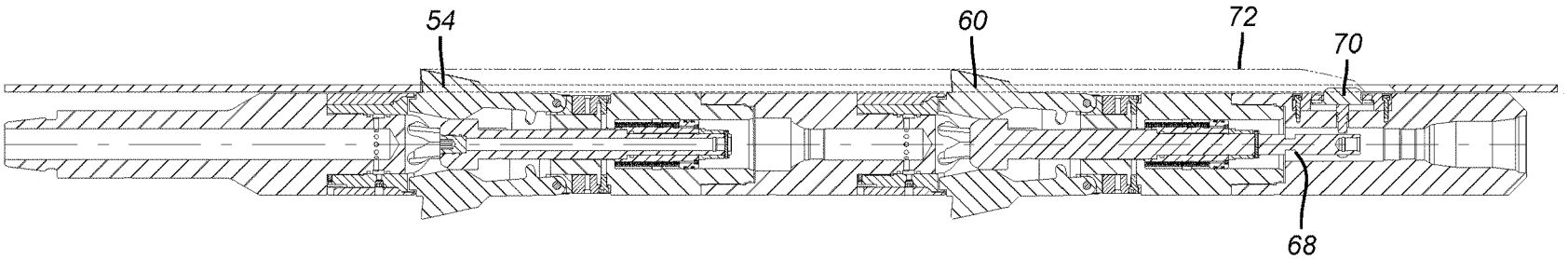
FIG. 5 is the view of FIG. 4 with the backup mill blades extended.

FIGS. 2-6 reflect a mechanical locking of the actuating piston 50 of the backup or secondary mill 52. FIG. 1 shows the run in position where blades 54 of the primary mill 56 are retracted in the manner previously described since there is no flow in passage 58. Blades 60 are retracted for the same reason. In both cases in FIG. 2 the springs 62 and 64 are the force to keep blades 54 and 60 retracted. In FIG. 2 pressure in passage 58 extends blades 54 in the manner previously described but blades 60 stay retracted because actuating piston 50 is physically retained against axial movement by rods or detents 66 best seen in FIG. 6 extending into respective grooves 68 in the body of piston 50. These grooves are best seen in FIG. 5 where the rods 66 have been moved axially with pressure that comes from passage 58 in combination with string manipulation that places caps 70 on rods 66 in alignment with a window 72 represented by a dashed line that has already been milled with blades 54. Caps 70 are retained for limited extension out in the radial direction and are biased inwardly by a spring 74 shown in FIG. 2. It is the application of pressure from passage 58 that is communicated to passage 76 that puts an outward force on the caps 70 against the bias of springs 74. However, it is only when the delivered pressure is high enough and the caps 70 are free to move out radially that conditions are met to allow radially outward movement of caps 70 that takes the rods 66 out of their respective grooves 68. Once the blades 60 come out, they take over the milling of the window 72. The blades 54 stay out as milling continues but do not do any further milling. Alternative ways to mechanically lock the actuating piston 50 of the backup mill 52 are contemplated. The body of the piston 50 can be simply shear pinned to a surrounding housing wall and those pins can shear with enough force. A j-slot mechanism with applied and removed pressure cycles can free the piston 50 to move axially to extend blades 60.

Those skilled in the art will appreciate that what has been described is a simple way to stagger the operation of two or move tools that are power in the same manner using simple devices that keep the tool cost down while offering reliable operation. When the tools are pressure operated the applied pressure is fed to the primary tool and the backup tool is isolated from such pressure until it needs to operate. At that point a barrier to the pressure is removed or a lock that prevents actuator movement while being exposed to the pressure can be defeated. In the preferred method of defeat of the mechanical locking the tools are repositioned to allow the pressure already present at the actuator for the backup tool to move a detent out of the way or fail such a detent to allow the piston to move and the associated blades with that piston to radially extend for continuation of the milling after the primary mill has worn. Although the system is described in the context of identical mills the tools in question need not be identical or for that matter need not be mills. A variety of pressure actuated tools can have their operations staggered in the above described manner. An isolation valve triggered remotely with a signal can be used in FIG. 1 as the barrier 42. The milling direction can be either uphole or downhole direction.

The above description is illustrative of the preferred embodiment and many modifications may be made by those skilled in the art without departing from the invention whose scope is to be determined from the literal and equivalent scope of the claims below:

We claim:

1. An assembly of borehole tools, comprising: a pressure operated primary tool connected in pressure communication through a housing with a pressure operated secondary tool; said secondary tool selectively locked in said housing against actuation responsive to pressure therein with a mechanical lock such that said primary tool can pressure operate by itself until said lock is defeated; said lock comprises at least one detent selectively engaged to an actuating piston for said secondary tool that is axially moveable in a housing for said secondary tool; said actuating piston further comprising at least one recess; said at least one detent extending into said at least one recess; said at least one detent is biased into said at least one recess; wherein pressure in said housing provides a force on said at least one detent away from said at least one recess; and said at least one detent is only able to move out of said at least one recess when said detent is placed in alignment with a space created by operation of said primary tool.

2. The assembly of claim 1, wherein: said pressure on said at least one detent overcoming said bias when said detent is aligned with said space created by operation of said primary tool.

3. The assembly of claim 2, wherein:

said primary and secondary tools comprise mills with pivoting blades.

4. The assembly of claim 3, wherein:

engagement of said detent to said actuating piston prevents pivoting of said blades.

5. An assembly of borehole tools, comprising:

a pressure operated primary tool connected in pressure communication with a pressure operated secondary tool;

said secondary tool selectively locked against actuation responsive to pressure therein with a mechanical lock such that said primary tool can be pressure operated alone until said lock is defeated;

said primary and secondary tools comprises mills with pivoting blades;

said blades of said primary mill remain extended after said blades from said secondary mill are extended.

* * * * *